United States Patent [19]

Henderson

[11] Patent Number: 4,693,690

[45] Date of Patent: Sep. 15, 1987

[54] QUICK DRAIN ASSEMBLY FOR BOAT ENGINE

[76] Inventor: Elvin J. Henderson, 1407 N. Pecos, Fort Stockton, Tex. 79735

[21] Appl. No.: 837,958

[22] Filed: Mar. 10, 1986

[51] Int. Cl.[4] ..... B63H 21/38

[52] U.S. Cl. ..... 440/88; 114/183 R; 114/197; 123/41.14

[58] Field of Search ..... 114/182, 183 R, 197, 114/198; 440/88; 123/41.01, 41.14; 137/625.4, 602

[56] References Cited

U.S. PATENT DOCUMENTS

| | | | |
|---|---|---|---|
| 3,528,087 | 9/1970 | Perkins | 137/625.4 |
| 3,812,810 | 5/1974 | Moeller | 114/197 |
| 4,176,708 | 12/1979 | Joffe | 123/41.14 |
| 4,461,250 | 7/1984 | Mohr | 440/88 |
| 4,542,373 | 9/1985 | Hillock | 114/197 |

*Primary Examiner*—Joseph F. Peters, Jr.
*Assistant Examiner*—Thomas J. Brahan
*Attorney, Agent, or Firm*—Marcus L. Bates

[57] ABSTRACT

A quick drain device for an inboard boat engine, especially an engine of the type having a water jacket to which a plurality of drain cocks are connected through which the engine coolant must be drained after each use of the engine. The quick drain device is in the form of a barrel having a plurality of lateral tube radiating therefrom. An expandable stopper is received within the barrel and covers the ends of the tubes and thereby prevents flow therethrough. The other ends of the lateral tubes are connected to the drain cocks or drain plugs located on the engine block. Removal to the expandable stopper simultaneously drains all of the drain plugs.

15 Claims, 4 Drawing Figures

QUICK DRAIN ASSEMBLY FOR BOAT ENGINE

BACKGROUND OF THE INVENTION

Many small pleasure boats have inboard motors of various different configurations, as for example four cylinder inline motors, V-8 motors, straight 6 motors, V-6 motors, and the like. These inboard motor boats usually received at the owner's home and are transported to the lake each time the owner wishes to enjoy the pastime of motor boating. The motor boats are usually transported to and from the lake by a trailer made especially for hauling the boat. The motor and propeller drive system is often made into the configuration of an inboard/outboard arrangement, known to those skilled in the art.

The internal combustion motors used in these motor boats usually are of the water cooled type. The motor drives a water pump which causes lake water to be pumped directly from the lake, through the cooling jacket of the motor, and back into the lake. Accordingly, any contamination contained within the lake water are transferred into the cooling system of the motor boat. These contaminants are usually considerable and cause subsequent undesirable chemical reactions to occur within the motor water jacket and therefore should be removed from the motor after each boating trip.

All internal combustion motors have provisions by which the water jacket can be completely drained of coolant. Sometimes the manufacturer provides plugs which must be removed in order to drain the water jacket, while other manufacturers place a drain cock on the engine block which is connected at an elevation which enables various different parts of the cooling system to be drained. Usually the drain plugs, or drain cocks, are found at some inaccessible location which renders manipulating the cock or removing the plug very difficult. This inconvenience often results in skinned knuckles, burned hands, and over a period of time the drain plugs and cocks become unduly worn, especially if the boat owner opens and closes the plugs or cocks with improper tools, such as a pair of pliers, for example.

The inaccessability of drain plugs and drain cocks on a motorboat motor causes one to procrastinate in his duties of draining the cooling system, which results in accelerated corrosion and fouling of the cooling system. This is detrimental to the life of the motor. During the winter, in cold regions of the country, the failure to drain the cooling system of an inboard motor can result in the water jacket freezing. This catastrophe often cracks or breaks the cylinder head or cylinder block or water jacket exhaust manifolds unless one is very fortunate and the freezed plugs are pushed from the block, thereby avoiding serious damage.

It would therefore be desirable to have made available a means by which the water jacket of an inboard motor can be easily and conveniently drained by a single manipulation of some sort of drain device. Moreover, it would be desirable that such a drain device be conveniently located so that it is readily accessible by the boat operator. Such a desirable apparatus is the subject of the present invention.

| THE PRIOR ART | |
|---|---|
| 1,107,635 | 2,032,670 |
| 1,623,902 | 2,107,870 |
| 1,649,277 | 2,408,183 |
| 1,697,011 | 2,857,892 |
| 1,924,250 | 4,133,284 |

SUMMARY OF THE INVENTION

The present invention provides a quick drain apparatus by which coolant can be drained from an engine block of an inboard motorboat motor. The apparatus includes a main cylindrical housing having an axial passageway formed therethrough. The cylindrical housing is preferably in the form of a barrel having opposite opening ends.

An expansible packer device in the form of a stopper is removably received within the main housing, preferably telescoped into the upper marginal end of the main housing. The packer device has a convenient handle by which a packer element associated therewith can be expanded and retracted.

The cylindrical housing has a plurality of lateral tubes attached thereto and extending therefrom. Each of the lateral tubes have opposed ends. One of the ends of each tube is affixed to the main housing and the opposed end extends away from the main housing. The interior of each of the tubes communicate with the interior of the housing. The tube ends preferably are attached to the upper marginal end of the housing at a location where the tube ends are jointly covered by the packer element when the packer device is set; that is, when the packer device is placed within the main housing and expanded into sealed relationship respective to the ends of the tubes.

The free ends of each of the tubes are connected by a flexible hose to one of the drain plugs of the engine block. The cylindrical housing is mounted respective to the water jacket whereby when the packer device is removed from the cylindrical housing, water can gravitate from the motor water jacket, through the hose and lateral tubes, into the cylindrical housing, and into the bilge of the boat.

Accordingly, a primary object of the present invention is the provision of a quick drain device for simultaneously draining a fluid from a plurality of locations.

Another object of the present invention is the provision of a quick drain device for connecting to a plurality of different drain conduits by which a flow from the plurality of conduits can be simultaneously controlled.

A still further object of the present invention is the provision of a quick drain apparatus for simultaneously draining all of the outlets of an inboard motorboat engine block.

Another and still further object of the present invention is the provision of a quick drain device for a water cooled motor of an inboard motorboat which enables the water jacket of the motor to be easily drained in a new and unobvious manner.

An additional object of the present invention is the provision of a means for simultaneously opening or closing all of the drain cocks of a water cooled motor by the employment of a cylindrical housing having a plurality of lateral tubes radiating therefrom and connected thereto, with there being a packer device sealingly received within the housing at a location to seal off each of the near ends of the tubes, so that the far end of the tubes can be connected to various different locations on the water jacket of the engine block, and when the packer is removed, all of the tubings simultaneously drain the block.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described in the above abstract and summary.

DETAILED DESCRIPTION OF THE PREFERRED EMBODIMENT

Figure 1:
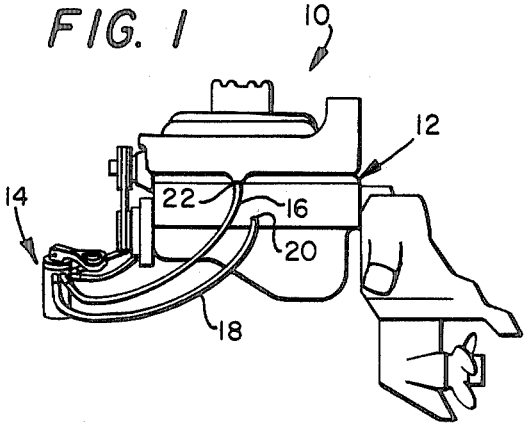
FIG. 1 sets forth a part schematical, part diagrammatical illustration of an inboard motorboat engine having apparatus made in accordance with the present invention associated therewith.

In FIG. 1 of the drawings, there is diagrammatically illustrated a combination 10, comprised of a water cooled engine block 12 to which there is operatively connected a boat engine quick drain device 14 of the present invention. Hoses 16 and 18 are connected between the quick drain device 14 and the engine block 12 by means of a suitable fitting, such as a plurality of drain cocks or drain plugs 22. The drain plugs 22 are located at the lower extremity of each of the water jacket cavities contained within the engine, commonly referred to as the engine water cooling chamber.

Figure 2:
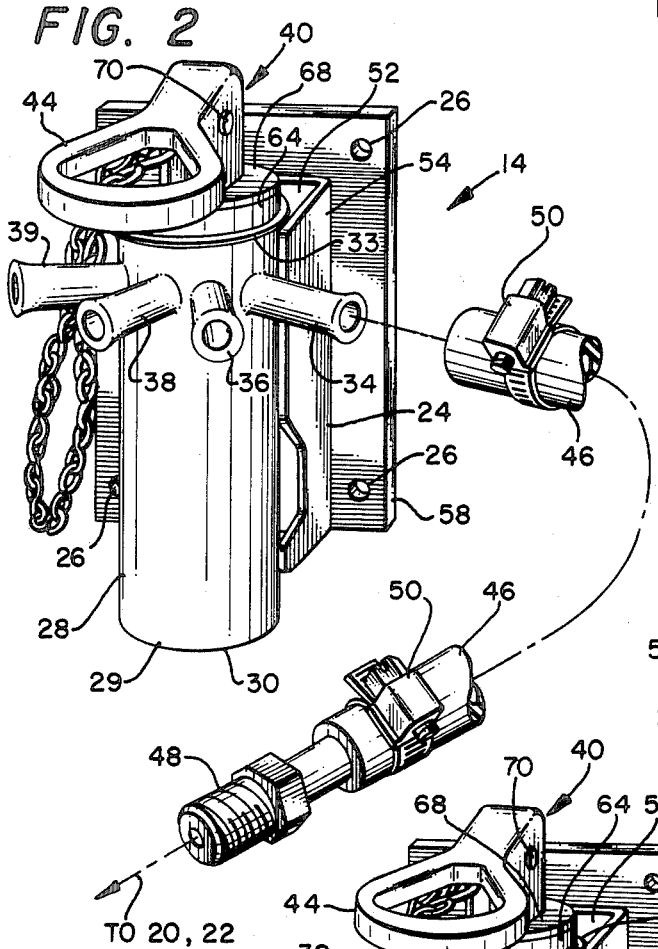
FIG. 2 is an enlarged, perspective view of the present invention.

FIG. 2 is an enlarged, detailed view of the boat engine quick drain 14. The apparatus 14 includes a bracket 24 by which the drain device can be suitably mounted to the engine, or to boat structure adjacent to the engine, by means of a bolt or screw received through bolt holes 26.

Figure 3:
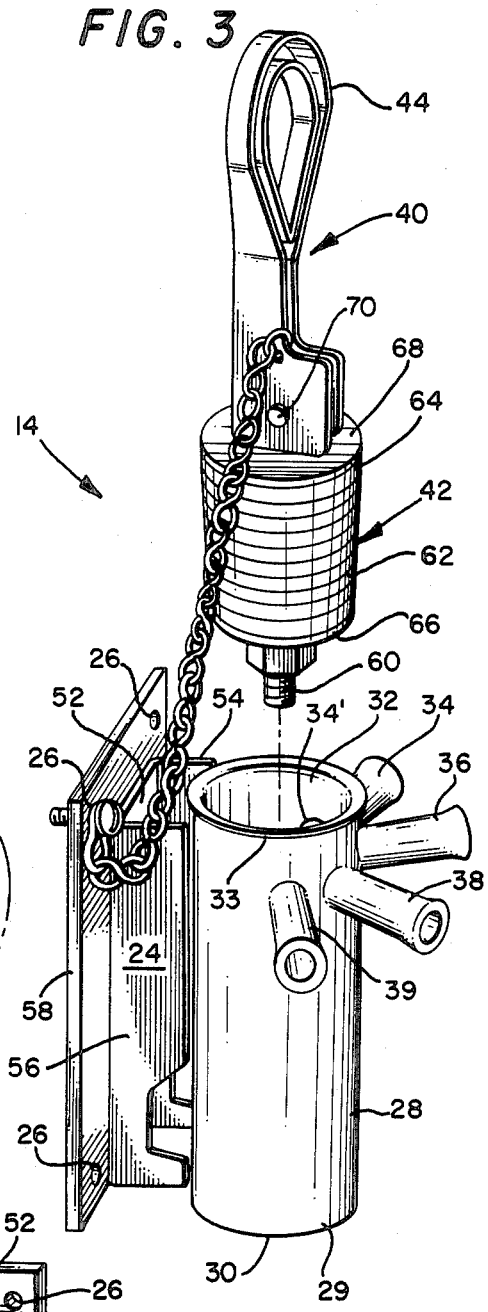
FIG. 3 is a part cross-sectional, disassembled, perspective view of the apparatus disclosed in FIG. 2; and, FIG. 4 is a part cross-sectional view of the apparatus disclosed in the foregoing figures.

In FIG. 3, together with other figures of the drawings, the apparatus 14 is seen to include a main cylindrical housing 28 having a lower circumferentially extending edge 29. The main housing downwardly opens as indicated by the numeral 30, and upwardly opens at 32. The housing includes an upper terminal end 33 which preferably is in the form of an outwardly curved lip made in the manner of a bugle.

A plurality of lateral tubes 34, 36, 38, and 39 have a near end affixed to the main housing 28, and a far end which radiates from the longitudinal axial centerline of the main housing. The lateral tubes each have a passageway formed therethrough which opens into the longitudinal axial passageway of the main housing. The plurality of lateral tubes preferably lie in a common plane which is arranged perpendicularly respective to the longitudinal axial centerline of the main housing. It is preferred that the plurality of lateral tubes 34–39 be located on the side opposite of the main housing to which the bracket 26 is affixed.

Figure 4:
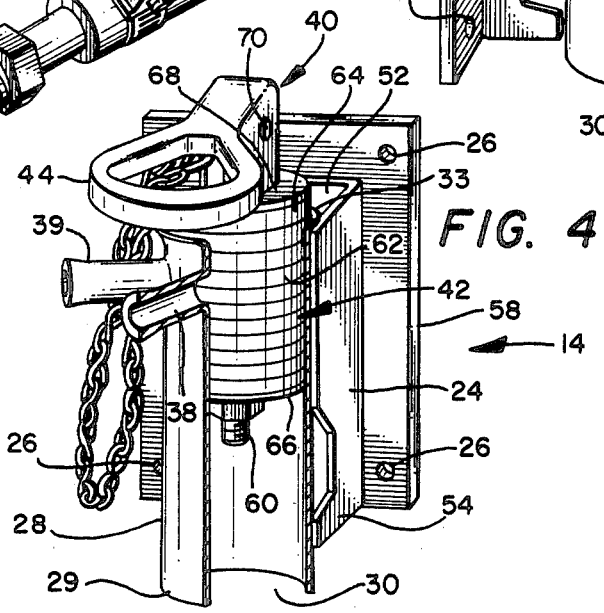

A packer device 40, preferably a commercially available expandable stopper is of a suitable size to be telescopingly received within the longitudinal passageway of the main housing, in the illustrated manner of FIGS. 2 to 4. The packer device 40 includes a packer element 42 which is expanded and retracted by manipulation of handle 44, thereby changing the diameter of the device. The handle, when positioned according to the illustration of FIG. 2, expands the packer element 42 into sealed relationship respective to the inside periphery wall surface of the main housing. The packer, when the handle 44 is moved into the illustrated position seen in FIG. 3, relaxes the packer element 42 into the unseated configuration and thereby enables the packer apparatus to be removed from the main housing.

The far end of each of the lateral tubes 34–39 receive a hose 46. The other end of the hose is provided with a suitable fitting 48 for connection to the engine block at 20 or 22. Hose clamps 50 secure the marginal ends of the hose to the far end of the lateral tube and to the fitting 48.

The bracket 24 includes walls 52 bent into a U-shaped configuration, with there being outwardly directed spaced walls 54, 56 attached to a plate member 58. Apertures formed through the plate member 58 provide a convenient means by which the bracket can be bolted to the engine block, or to the accessories associated with the engine block. The walls 56 are attached to the main housing 28, thereby rigidly securing the main housing to the bracket.

The packer 40 includes a mandrel 60 extending through the packer element. The packer element has a resilient compressible outer wall surface 62. The packer element terminates in a washer 64 which provides a bearing surface against which the over-the-center handle 44 rides in order to urge the washer 68 towards the washer 66, thereby compressing the resilient packer element 42 therebetween, and increasing the diameter of the packer element so that it is expanded into sealed relationship respective to the inner periphery wall surface of the cylindrical member 28.

In operation, the assembly of FIG. 2 is mounted at an elevation below the drain plugs 20, 22 of the engine block. Fittings 48 are attached to each of the drain plugs 20, 22 and the hoses 46 secured to the far ends of the lateral tubing and the end of the fitting 48. The hose clamps are made up and the packer is placed within the main housing. The handle 44 is rotated into the horizontal position as illustrated in FIG. 2 which simultaneously stops flow through the apparatus.

After a boating trip, the cooling water jacket of the motor will be filled with water. After the motor has been shut down, the packer apparatus 40 is removed from the main housing by rotating the handle 44 into the illustrated vertical position seen in FIG. 3. The packer device is removed from the main housing, thereby enabling the water to gravitate from the water jacket, through the fittings 48, through the hose, through each of the lateral tubings 34–39, where the water drains from the lower open end 30 of the main housing and into the bilge of the motorboat. This action completely drains the engine block so that corrosion and the danger of freezing and bursting the block is obviated.

The next trip to the lake requires that the packer element be returned into the main housing in the illustrated manner of FIG. 2.

It is considered within the comprehension of this invention to close the upper end 32 of the barrel 28, and to insert the plug 40 through the bottom 30 of the barrel 28 and into sealed relationship respective to the lateral tubes 34–39. In FIG. 3, the barrel 28 is disclosed slightly spaced from bracket 24. The barrel 28 can be removably affixed to the bracket by clamping or screwing, or alternatively welded or soldered into fixed position.

The free ends of the lateral tubes 34–39 can be made as shown, or alternatively they can be provided with various commercially available hose fittings depending upon the cost and detail of design one may deem desirable.

The present invention provides a means of positiively draining a motorboat water jacket; and, one can visually ascertain that the water jacket is properly drained by visual inspection during the operation. Any obstruction caused by foreign matter such as moss, grass, dirt, rust, and other debris is readily ascertained visually when the present invention is used in the above described manner.

I claim:

1. A quick drain apparatus for draining water from an engine block of a boat engine, comprising:

a main cylindrical housing having an axial passageway formed therethrough; a packer device removably received within said main housing, said packer device has a packer element which is expandable into sealed relationship respective to the inner wall surface of the main housing, said packer element is retractable into a reduced diameter releasable configuration which enables the packer device to be removed from said main housing;

a plurality of lateral tubes each having a near end opposed to a far end, with the near end of each said lateral tube being affixed to the wall surface of the main housing with the far end of each said lateral tube extending away from said main housing; a passageway formed through each lateral tube and into said main housing;

said near end of each said lateral tube being located adjacent to one end of said main housing at a location which is covered by said packer element when said packer element is sealingly received within said main housing.

2. The quick drain apparatus of claim 1 wherein said packer device has a handle, means by which one movement of said handle causes said packing element to be expanded into sealed relationship within said housing; and, another movement of said handle causes the packing element to be reduced in diameter and released from said housing.

3. The quick drain apparatus of claim 2 wherein said lateral tubes are aligned in a plane which is perpendicular respective to the longitudinal axis of said main housing;

the plane through said tubes extends perpendicularly through the packer device and through a medial length of said packer element when said packer device is sealingly received within said main housing.

4. The quick drain apparatus of claim 3 wherein a bracket is affixed to said main housing, said bracket includes a flange by which said main housing can be mounted respective to an engine whereby said main housing can be located at an elevation to cause water to gravitate from the engine block and to the housing when the packer is removed therefrom.

5. The quick drain apparatus of claim 1 wherein said lateral tubes are aligned in a plane which is perpendicular respective to the longitudinal axis of said main housing;

the plane through said tubes extends perpendicularly through the packer device and through a medial length of said packer element when said packer device is sealingly received within said main housing.

6. The quick drain apparatus of claim 1 wherein a bracket is affixed to said main housing, said bracket includes a flange by which said main housing can be mounted respective to an engine whereby when said packer device is released from said main housing, any water contained within the engine block can gravitate to the main housing.

7. The quick drain apparatus of claim 1 wherein said packer device has a handle, means by which movement of said handle in one direction causes said packing element to be expanded and movement of the handle in another direction causes the packing element to be relaxed;

wherein said lateral tubes are aligned in a plane which is perpendicular respective to the longitudinal axis of said main housing;

the plane through said tubes extends through the packer device and through a medial length of said packer element when said packer device is sealingly received within said main housing;

wherein a bracket is affixed to said main housing, said bracket includes a flange by which said main body can be mounted respective to an engine whereby said main housing can be located at an elevation to cause water to gravitate from the engine block and to the housing when the packer is removed therefrom.

8. A packer actuated valve device for draining water from an engine block of a boat engine, comprising:

a barrel in the form of a main cylindrical housing having a downwardly, opening axial passageway formed therein; a packer device removably received within said axial passageway, said packer device includes a packer element thereon which is expandable into sealed relationship respective to the inner wall surface of the passageway, said packer element is retractable into a reduced diameter releasable configuration which enables the packer device to be removed from sealed relationship respective to said passageway;

means forming a plurality of lateral flow passageways, each having a near end opposed to a far end, with the near end of each said lateral flow passageway being affixed to the wall surface of the main housing, with the far end of each said lateral flow passageway extending away from said main housing; each said lateral passageway extends into communication with said axial passageway;

said near end of each said lateral passageway being located adjacent to one end of said main housing at a location which is covered by said packer element when said packer element is sealingly received within said main housing.

9. The valve device of claim 8 wherein said packer device has a handle, means by which one movement of said handle causes said packing element to be expanded into sealed relationship within said axial passageway; and, another movement of said handle causes the packing element to be reduced in diameter and released from said housing.

10. The valve device of claim 8 wherein said lateral passageways are aligned in a plane which is perpendicular respective to the longitudinal axis of said main housing;

the plane through said passageways extends perpendicularly through the packer device and through a medial length of said packer element when said packer device is sealingly received within said main housing.

11. The valve device of claim 8 wherein a bracket is affixed to said main housing, said bracket includes a flange by which said main housing can be mounted respective to an engine whereby when said packer device is released from said main housing, any water contained within the engine block can gravitate to the main housing.

12. Apparatus for rapidly draining water simultaneously from a plurality of drain locations on an engine block of a boat engine, comprising:

a main housing having an axial passageway formed therein; a packer device removably received within said passageway, said packer device has a packer element which is expandable into sealed relationship respective to the inner wall surface of the passageway, said packer element is retractable into a reduced diameter releasable configuration which enables the packer device to be removed from sealed relationship respective to the passageway of said main housing;

a plurality of lateral passageways, each having a near end opposed to a far end, with the near end of each said lateral passageway being connected to the axial passageway of the main housing, and with the far end of each said lateral passageway extending away from said main housing;

said near end of each said lateral passageway being located adjacent to one end of the axial passageway of said main body at a location which is covered by said packer element when said packer element is sealingly received within the axial passageway of said main housing.

13. The drain apparatus of claim 12 wherein said packer device has a handle, means by which one movement of said handle causes said packing element to be expanded into sealed relationship within said housing; and, another movement of said handle causes the packing element to be reduced in diameter and released from said housing.

14. The drain apparatus of claim 12 wherein said lateral passageways are aligned in a plane which is perpendicular respective to the longitudinal axis of said main housing;

the plane through said passageways extends perpendicularly through the packer device and through a medial length of said packer element when said packer device is sealingly received within said main housing.

15. The drain apparatus of claim 12 wherein a bracket is affixed to said main housing, said bracket includes a flange by which said main housing can be mounted respective to an engine whereby when said packer device is released from said main housing, any water contained within the engine block can gravitate through said lateral passageways and to the main housing.

* * * * *

UNITED STATES PATENT AND TRADEMARK OFFICE

CERTIFICATE OF CORRECTION

PATENT NO. : 4,693,690

DATED : September 15, 1987

INVENTOR(S) : Elvin J. Henderson

It is certified that error appears in the above-identified patent and that said Letters Patent is hereby corrected as shown below:

On the title page, Abstract, line 6, "tube" should read -- tubes --.

Column 1, line 9, "received" should read -- are stored --.

Column 5, line 65, "1" should read -- 2 --.

Column 8, line 5, claim 12, "body" should read -- housing --.

Signed and Sealed this

Nineteenth Day of July, 1988

*Attest:*

DONALD J. QUIGG

*Attesting Officer*

*Commissioner of Patents and Trademarks*